United States Patent [19]

Totten

[11] Patent Number: 5,044,182

[45] Date of Patent: Sep. 3, 1991

[54] AUTOMATIC DEADBOLT

[76] Inventor: Clyde D. Totten, 31317 Unit F, The Old Rd., Castaic, Calif. 91384

[21] Appl. No.: 568,632

[22] Filed: Aug. 16, 1990

Related U.S. Application Data

[63] Continuation of Ser. No. 249,575, Sep. 26, 1988, abandoned, which is a continuation-in-part of Ser. No. 216,074, Jul. 7, 1988, abandoned.

[51] Int. Cl.[5] ..... E05B 55/00

[52] U.S. Cl. ..... 70/143; 292/169.13; 292/169.14

[58] Field of Search ..... 70/143; 292/169.13, 292/169.14, 334, 335

[56] References Cited

U.S. PATENT DOCUMENTS

| | | | |
|---|---|---|---|
| 1,191,539 | 7/1916 | Schoell | 70/143 |
| 1,557,374 | 10/1925 | Soley | 70/143 |
| 1,944,382 | 1/1934 | Wecker | 292/334 |
| 2,576,648 | 11/1951 | Smith | 292/169.13 |
| 3,144,266 | 8/1964 | Schmid et al. | 292/169.13 |
| 3,353,858 | 11/1967 | Neavy et al. | 70/143 |
| 3,872,697 | 3/1975 | Wellekens | 70/371 X |
| 3,891,255 | 6/1975 | Millett | 70/143 X |
| 3,912,309 | 10/1975 | Fischer et al. | 292/167 |
| 3,930,677 | 1/1976 | Hollis | 70/143 X |
| 3,933,380 | 1/1976 | Wellekens | 70/143 X |
| 4,739,638 | 4/1988 | Lin | 292/335 X |

FOREIGN PATENT DOCUMENTS

| | | | |
|---|---|---|---|
| 618958 | 3/1949 | United Kingdom | 292/335 |

*Primary Examiner*—Lloyd A. Gall

*Attorney, Agent, or Firm*—Blakely, Sokoloff, Taylor & Zafman

[57] ABSTRACT

An automatic deadbolt and combined latch and automatic deadbolt is disclosed whereby a manually operable control on the inside of a door may be used to enable and disable the automatic extension of the latch bolt to a comparable deadbolt position upon the closing of the door. This allows one not having a key to the lock to set the manual control and then leave a premises, whereby upon the closing of the door the latch bolt will automatically extend to a deadbolt position, being retractable therefrom to again open the door either by the use of a key from outside, or by rotation of the inner latch control to withdraw the latch. Withdrawing the latch to open the door resets the deadbolt function in the embodiment described so that upon subsequent reclosing of the door, the automatic deadbolt function will not be reactivated unless specifically called for by control of the inside side of the lock mechanism. In addition to the automatic deadbolt function, the latch may also be extended from its normal door latched position to the extended deadbolt position externally through the use of the normal lock key. An alternate embodiment in the form of an automatic deadbolt is also disclosed.

13 Claims, 6 Drawing Sheets

Fig. 4
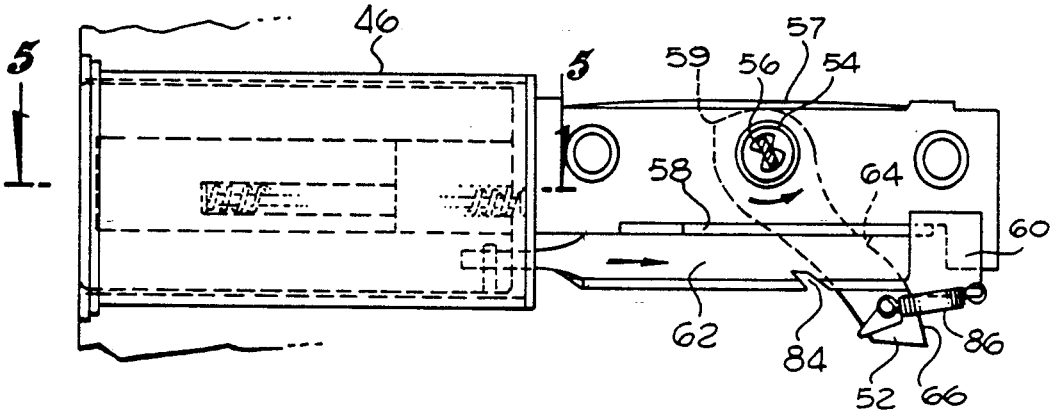
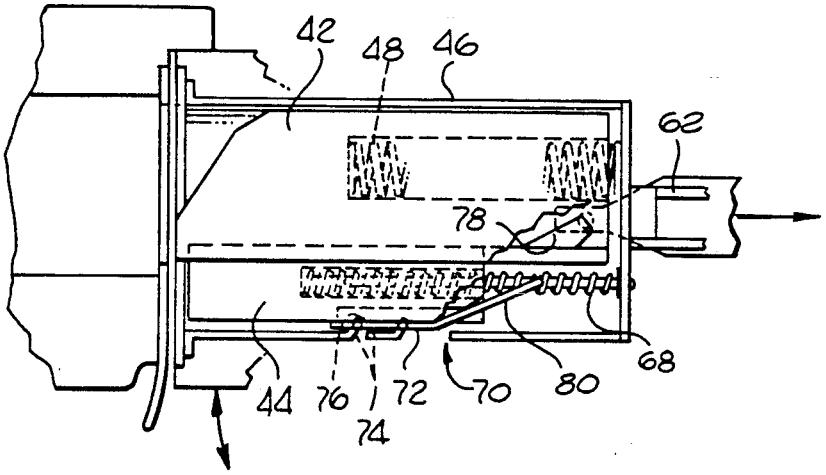
Fig. 5
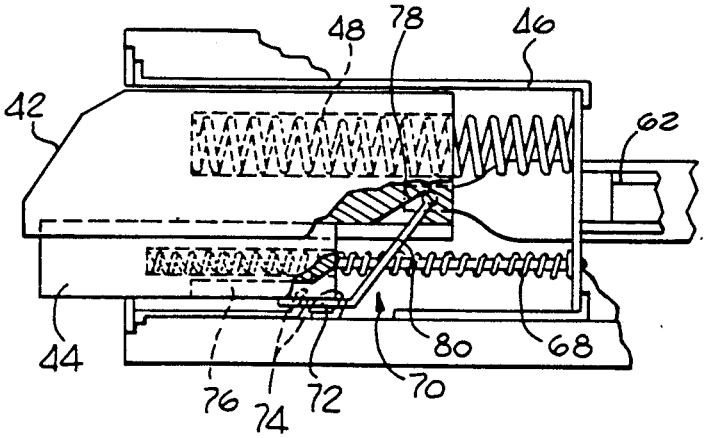
Fig. 6

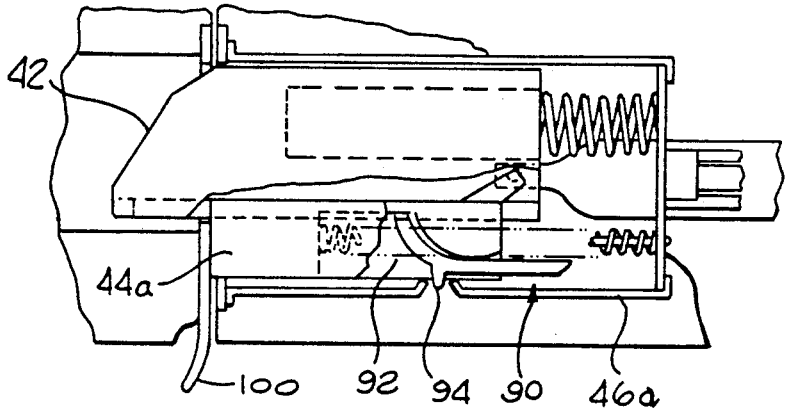
Fig. 11
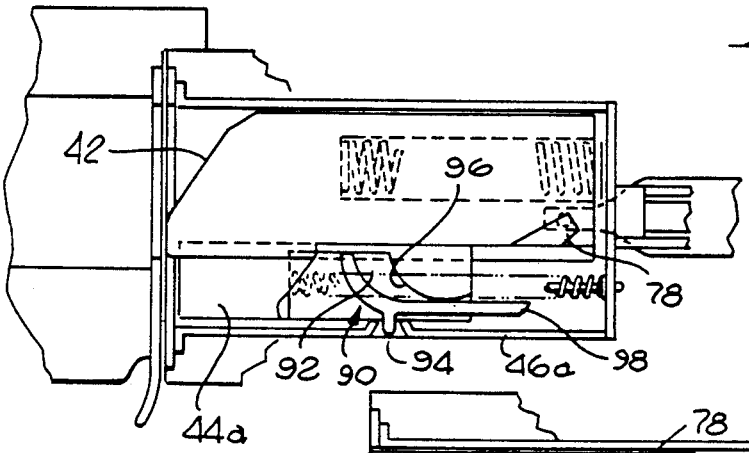
Fig. 12
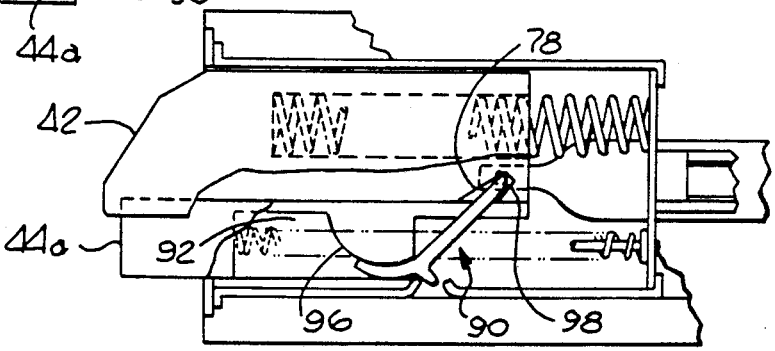
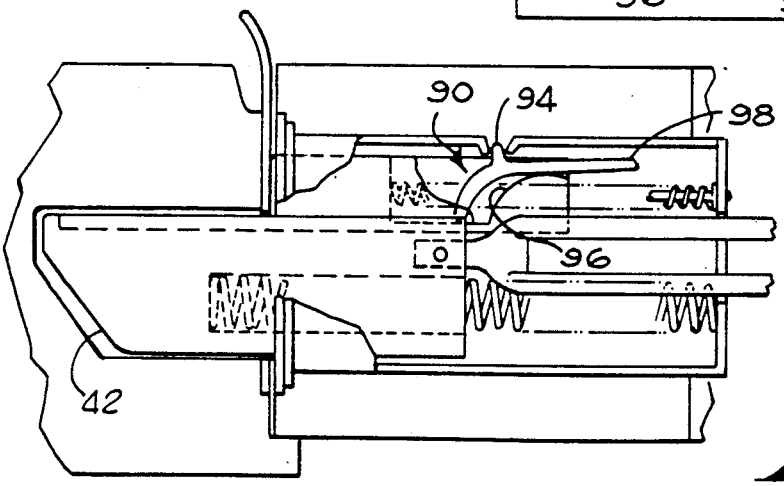
Fig. 13
Fig. 14

Fig. 15
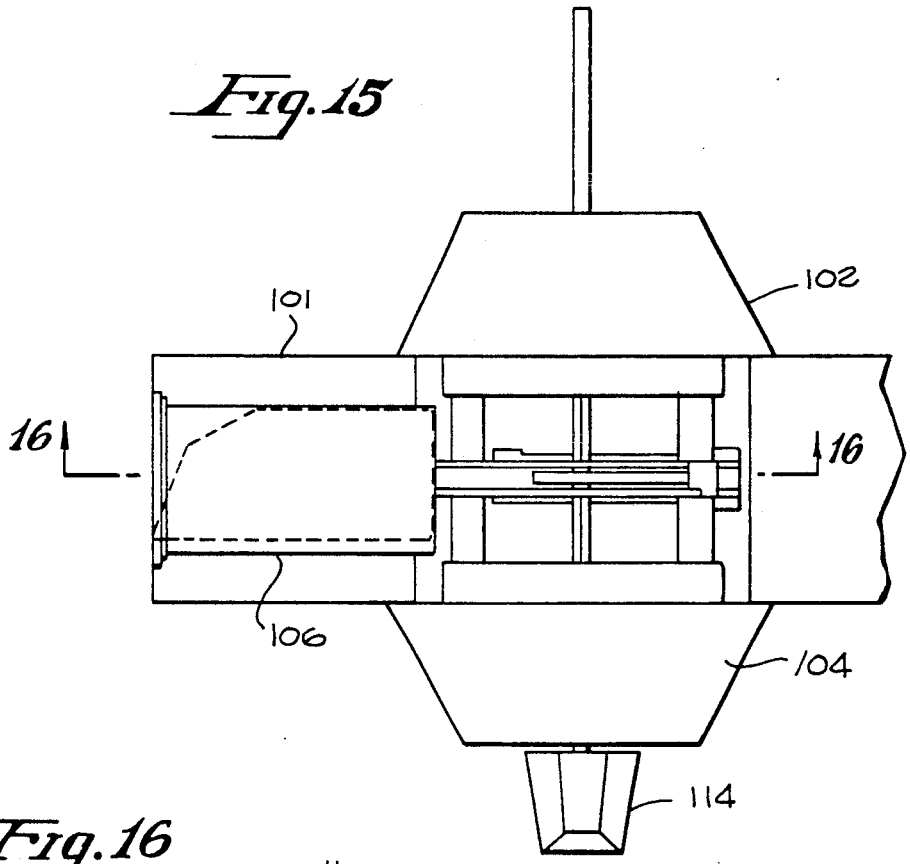
Fig. 16
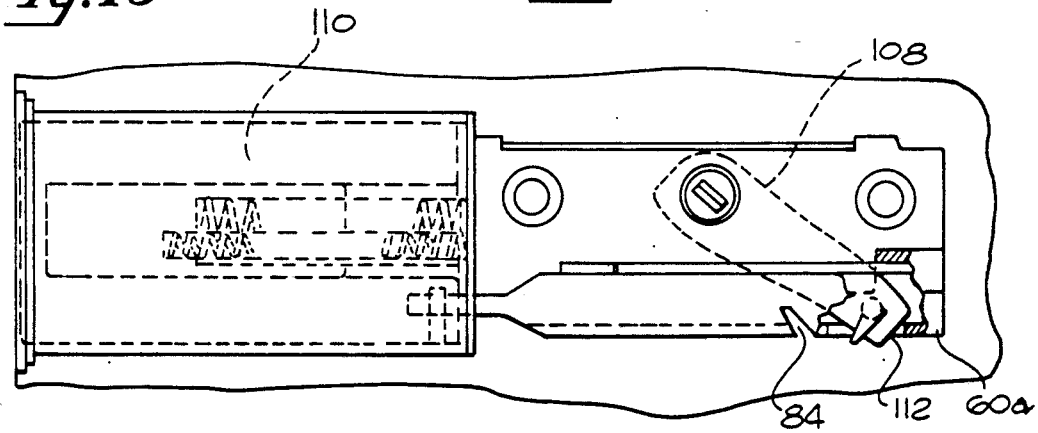
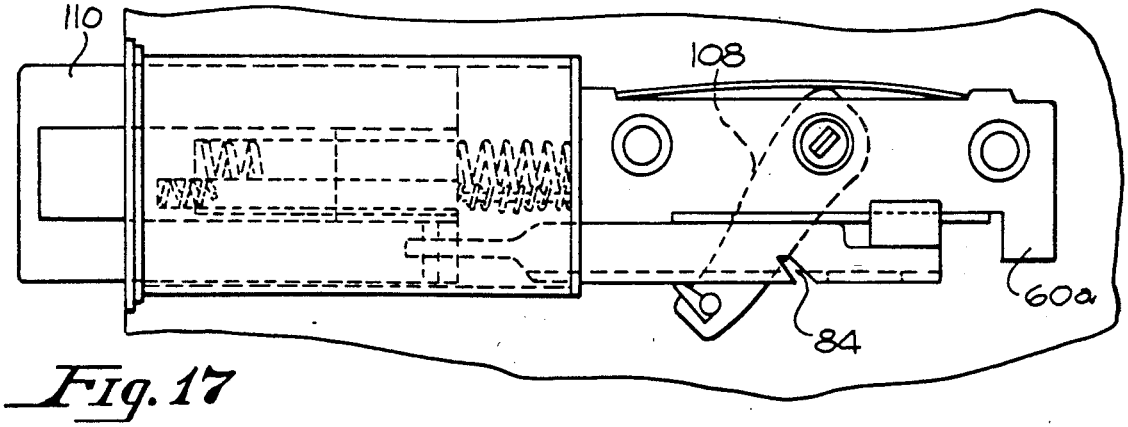
Fig. 17

AUTOMATIC DEADBOLT

This is a continuation of application Ser. No. 07/249,575 filed 9/26/88, now abandoned which application was a Continuation in Part of application Ser. No. 07,216,074 filed on 7/7/88, now abandoned.

BACKGROUND OF THE INVENTION

1. Field of the Invention

The present invention relates to the field of door latches, locks and deadbolts.

2. Prior Art

A normal door latch cooperates with a simple striker plate, to be cammed thereby to a latch withdrawn position against a spring encouraging the latch to an extended position, with the latch moving under the spring force to the extended position when the latch aligns with the opening in the striker plate at the door closed position. Without more, the latch may be cammed to the latch withdrawn position and the door opened by using a thin card or knife to reach between the door jamb and the door to withdraw the latch. This type of unwanted latch withdrawal is prevented in some locks by a sensing pin adjacent the latch which will cam with the latch on closing the door, though will intercept the striker plate and not extend when the latch springs into the opening in the striker plate. The extension of the latch without the corresponding extension of this sensing pin is operative to lock the latch in the extended position, and then make the same retractable only by the inner and outer knob. In either event however, a typical latch bolt will only extend no more than approximately one half inch into the striker plate. In most cases this will allow a would-be intruder to extend a pry bar between the edge of the door and the door jamb to sufficiently spring the combination to force the door open without withdrawing the latch.

To prevent the foregoing type of unauthorized entry, deadbolts are commonly used in addition to latch bolts. Such deadbolts do not cam on door closure, and accordingly must be manually placed in the withdrawn position for the opening and closing of the door; and thereafter manually extended by use of an external key, or on the inside, by a key or a simple manual control. In comparison to latches, deadbolts will extend into the plate on the door jamb much further than a simple latch bolt, such as by way of example, typically extending a full inch or more through the deadbolt plate and into the door jamb. This normally precludes forcible entry, as a typical door of any substantial structure cannot be sprung enough for the deadbolt to be withdrawn from the deadbolt plate.

Recently, the Wiser Lock Company introduced a lock set referred to as the Weiserbolt lock set having the outward appearance of a conventional latch bolt lock set, but which lock set further includes a "built-in security deadbolt". In one mode of operation, namely the unlocked mode, the lock set operates like a conventional latch set, the latch camming in the normal manner upon closure of the door and being retractable to open the door by operation of either the inner or outer door knobs. In the locked condition however, either through the use of a key from the outside or manual control from the inside, the latch bolt is further extended to a typical deadbolt position, and is retained at the extended position so as to not be camable or otherwise withdrawable, except through the use of the outer key lock or by rotation of the inner door knob. Extending the latch bolt to the normal deadbolt position also disengages the outer knob from the normal latch operating mechanism so that forcible rotation of the outer knob cannot withdraw the bolt.

The foregoing type of lock has a number of advantages. It is in general easier to install than lock sets which use a separate latch bolt and deadbolt, as fewer holes are required in both the door and the door jamb, and fewer assemblies must be attached thereto. Further, the foregoing lock is more convenient to use, as the door may be opened from the inside even when the bolt is extended to the deadbolt position by mere rotation of the knob, rather than by operation first of the deadbolt retracting mechanism and then rotation of the knob. It is of course also safer in that in an emergency such as a fire, the door may be opened from the inside, again by mere rotation of the knob, a natural human reaction when confronted with a closed door and requiring no more time than the opening of an unlocked door. The lock has one characteristic however, which is less than ideal, which the present invention overcomes. In particular, the latch can only be extended to the deadbolt position by operation of the manual control from inside the closed door or by use of the key lock from outside the closed door. This means that one leaving the premises without a key cannot use the deadbolt feature, as the latch can only be extended to the deadbolt position from outside by the use of the key. It is to this problem that the present invention is directed. In particular, in accordance with the present invention, the lock set may be set from inside, not to then extend the latch bolt to the deadbolt position, but rather to set the same so that upon closure of the door the latch bolt will first cam on the striker plate to allow the door to close, and then will automatically extend into the striker plate to the deadbolt extended position and lock at that position until withdrawn either through use of a key from the outside, or by rotation of the interior knob. Thus, unlike the present Wiser lock, the present invention will allow use of the deadbolt feature when leaving the premises without requiring the use of a key, a feature more convenient for those who have a key, and of course essential for the use of the deadbolt feature by those who do not have a key, but desire to extend the deadbolt for added security when they leave the premises.

In U.S. Pat. No. 3,353,858 a lock unit with an extendable latch bolt is disclosed. In this design a lock unit is provided with an extendable latch bolt having considerably more than the usual excursion or travel, so that more than the usual amount of latch bolt engages with the strike when the door is closed, but there is no abnormal projection of the latch bolt when the door is opened. However, the latch bolt itself is relatively short so that when fully extended very little of the latch bolt remains within the structure in the casing of the door to be very secure therein. Also, it appears that the latch bolt is extendable on every door closing whether the lock is locked or not, thereby increasing wear within the system and possibly increasing the actuation forces needed by a user when the lock is unlocked, which in most cases is the large majority of operations of the lock system. In U.S. Pat. Nos. 3,872,697 and 3,933,380, lock mechanisms are disclosed which have a bolt which can be automatically projected on closing of a door to an advanced or projected position and locked in such position to effectively serve as a dead bolt. These designs however are entirely different from that of the present invention, which is believed to be of greater simplicity and lower cost, as well as consistent with standard door jamb opening locations for conventional lock sets.

Finally, other mechanisms of similar characteristics are disclosed in U.S. Pat. Nos. 3,891,255, 3,912,309 and 3,930,677.

BRIEF SUMMARY OF THE INVENTION

An automatic deadbolt and combined latch and automatic deadbolt is disclosed whereby a manually operable control on the inside of a door may be used to enable and disable the automatic extension of the latch bolt to a comparable deadbolt position upon the closing of the door. This allows one not having a key to the lock to set the manual control and then to leave a premises, whereby upon the closing of the door the latch bolt will automatically extend to a deadbolt position, being retractable therefrom to again open the door either by the use of a key from outside, or by rotation of the inner latch control to withdraw the latch. Withdrawing the latch to open the door resets the deadbolt function in the embodiment described so that upon subsequent reclosing of the door, the automatic deadbolt function will not be reactivated unless specifically called for by control of the inside side of the lock mechanism. In addition to the automatic deadbolt function, the latch may also be extended from its normal door latched position to the extended deadbolt position externally through the use of the normal lock key. An alternate embodiment in the form of an automatic deadbolt is also disclosed.

BRIEF DESCRIPTION OF THE DRAWINGS

FIG. 4 is a view similar to that of FIG. 2 but with the latch bolt and sensing pin both withdrawn by manual operation of a doorknob or a locking member.

FIG. 5 is a partial cross-section taken along line 5—5 of FIG. 4.

FIG. 6 is a partial cross-section similar to FIG. 5 but with the latch bolt and sensing pin both extended to the normal latch bolt extended position.

FIGS. 11 through 14 are partial cross-sections of an alternate embodiment corresponding in general to the partial cross-sections of FIGS. 3, 5, 6 and 10, respectively.

FIG. 15 is a top view of the present invention as it may be incorporated in a dead bolt assembly showing the dead bolt in the unlocked position.

FIG. 16 is a partial cross-section taken along line 16—16 of FIG. 15.

FIG. 17 is a partial cross-section similar to FIG. 16 though showing the deadbolt lock in the locked position prior to the closing the door after locking the same.

DETAILED DESCRIPTION OF THE INVENTION

Figure 1:
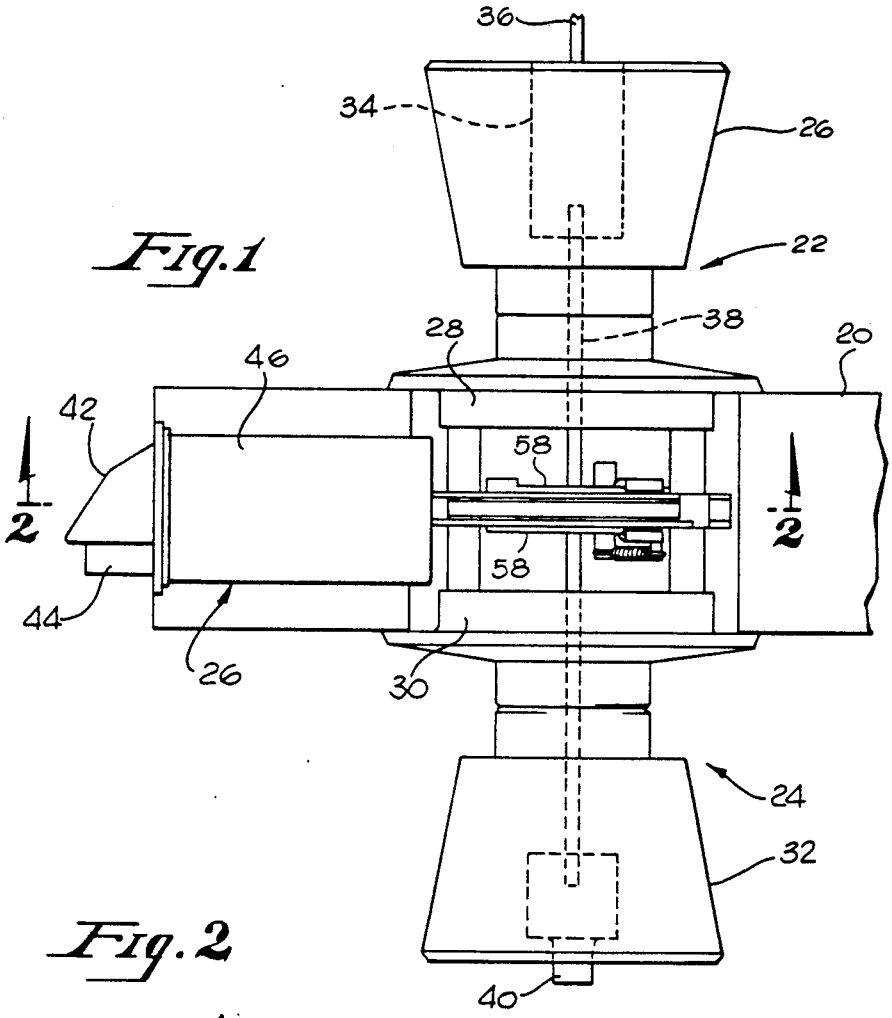
FIG. 1 is a top view of one embodiment of the present invention as mounted on a door.

First referring to FIG. 1, a top view of a Weiserbolt as modified in accordance with the present invention and mounted in a door 20 may be seen. The lock set is comprised of three major assemblies, specifically, an outer assembly generally indicated by the numeral 22, an inner assembly 24 and a latch bolt assembly 26. In the preferred embodiment of the present invention, the outer and inner assemblies 22 and 24 may be conventional Weiserbolt lock assemblies. Thus, by way of example, the outer assembly includes an outer knob 26 rotatably supported on an outer stationary member 28 fastened to the door by screws passing through the door to a corresponding inner stationary member 30, rotatably supporting the inner knob 32. Concentric with the outer knob 26 is a pin tumbler assembly 34 actuatable by a key 36 driving a tail piece 38 through an appropriate lost motion drive assembly. The tail piece in turn is also rotatable by an inner knob 32 with a lost motion drive therebetween, or by an inner manual control 40.

The latch assembly 26 includes a latch bolt 42 and an associated sensing pin 44. These components, which are slidable within a latch bolt assembly housing 46 and with respect to each other, are probably better seen in FIG. 2, which is a partial cross-section taken along line 2—2 of FIG. 1. The latch bolt 42 has an opening therein against which a coil spring 48 operates so as to encourage the latch bolt to the fully extended position, beyond that shown in FIGS. 1 and 2 to an equivalent deadbolt extended position. Connected to the latch bolt assembly housing 46 are first and second side plates 50 which among other things, support a cam member 52 for rotation about the axis of protrusion 54 thereon cooperatively fitting within an appropriate opening in one of the side pieces. Cam member 52 has a slot 56 therein to allow the tail piece 38 (see FIGS. 1 and 2) to pass therethrough and drive the same in rotation with a predetermined amount of lost motion upon rotation of the tail piece, with flat spring 57 acting on a lobe 59 on cam member 52 providing an over-center mechanism to encourage the cam member to either of two positions.

Figure 8:
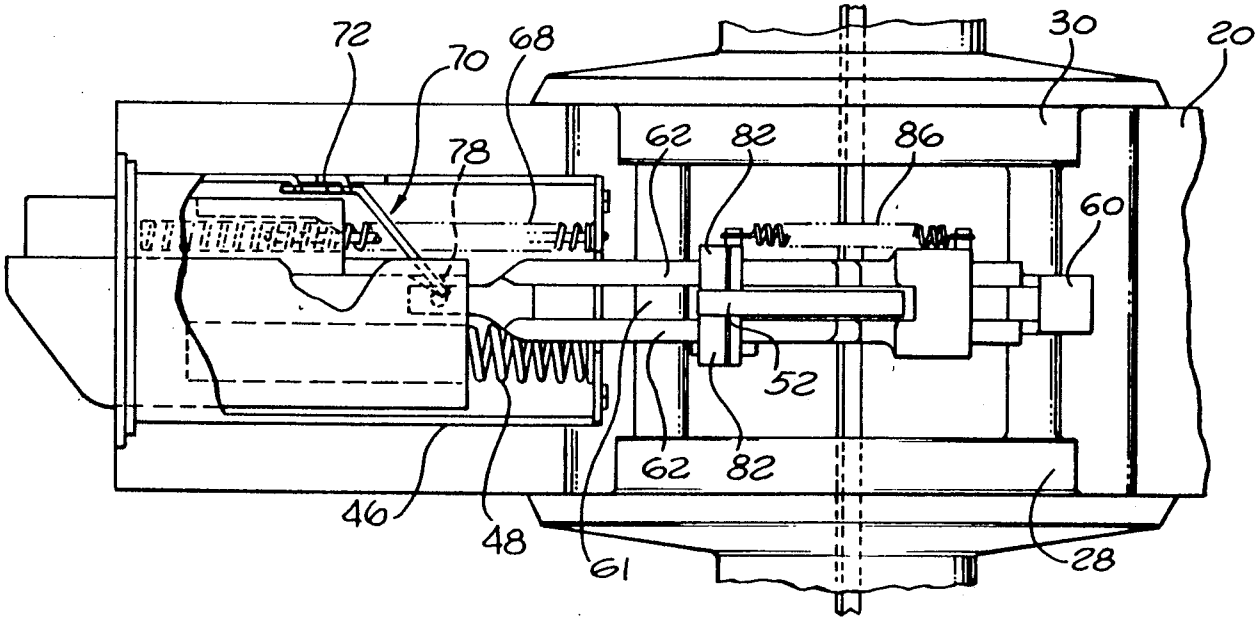
FIG. 8 is a partial cross-section taken along line 8—8 of FIG. 7.
Figure 10:
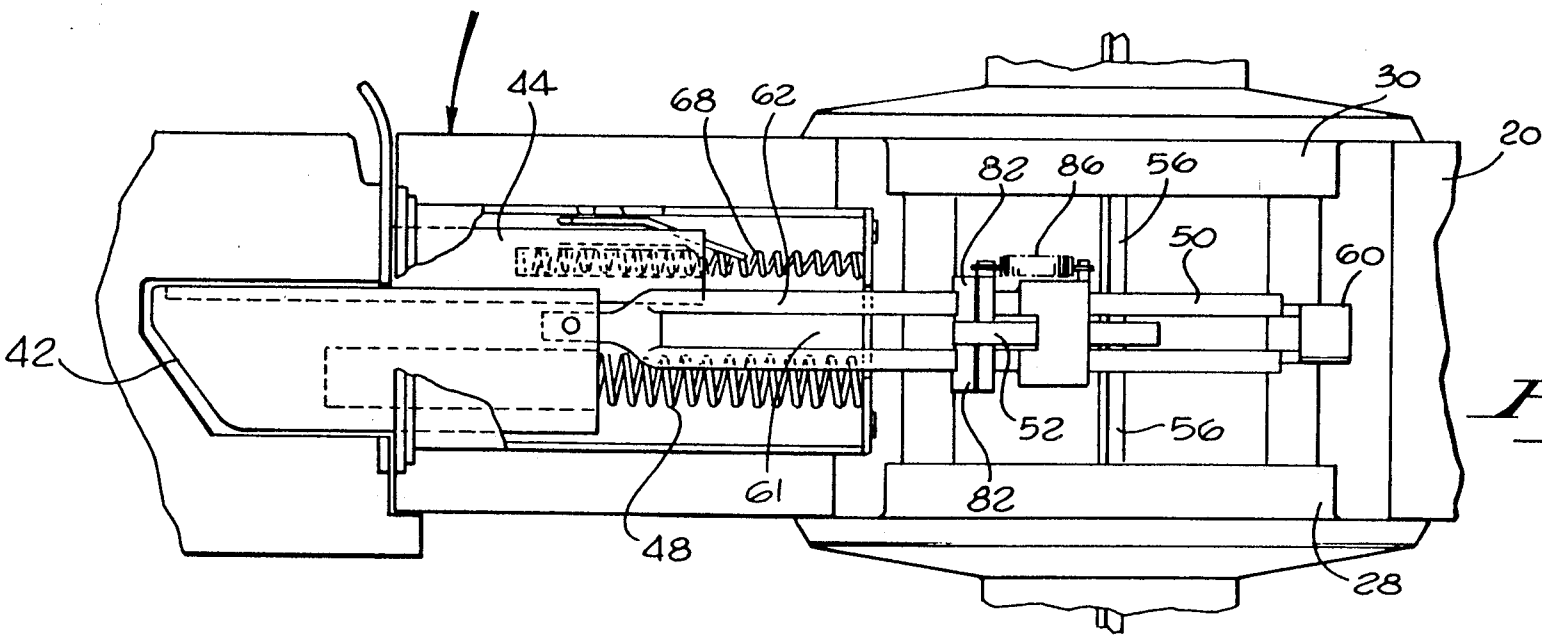
FIG. 10 is a partial cross-section taken along line 10—10 of FIG. 9.

The side plates 50 have outward extending flanges 58 on each side thereof, over which end 60 of a slide is retained, the end 60 being integral with side members 62 which extend parallel to each other and are integrally joined again adjacent to where they are attached to the latch bolt 42 to move in unison therewith, thereby defining an elongate slot 61 therebetween (see FIGS. 8 and 10). In the position shown in FIG. 2, cam member 52 extends between side members 62 of the slide, with a small finger 64 wedging under the central portion of end 60 of the slide to keep the same, and thus the latch bolt, from sliding to the latch bolt further extended position. Also, in this position the tailpiece slot 56 and thus the tailpiece extending therethrough is in a position to be operated by rotation of either the inner or outer knob of the Weiser knob assemblies. Such rotation, independent of direction, will cause the rotation of the cam member 52 in a counter clockwise direction as viewed in FIG. 2. This causes cam surface 66 to cam against the end 60 of the slide as shown in FIG. 4, withdrawing the latch bolt against spring 48 and withdrawing the sensing pin 44 therewith against spring 68, the sensing pin 44 already being at its outer most limit of travel with respect to the latch bolt in the slot therein within which a sensing pin slides.

Figure 3:
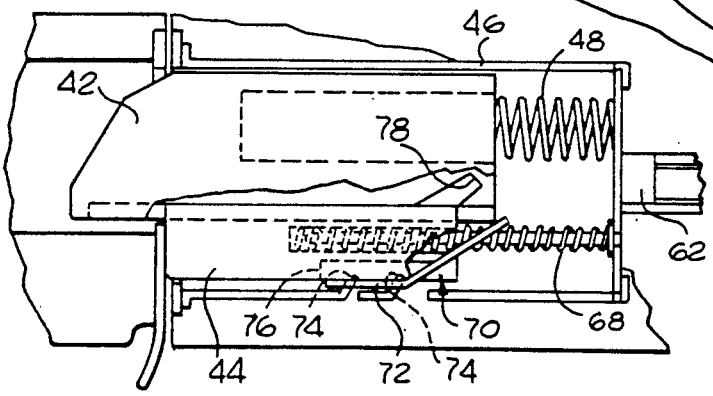
FIG. 3 is a partial cross-section similar to that of FIG. 2 but with the sensing pin held in the retracted position by a striker plate on a door jamb.

Mounted within the latch bolt assembly housing 46 of this embodiment is a spring member, generally indicated by the numeral 70 visible in FIGS. 3, 5 and 6. This spring member has a first spring portion 72 having two holes therein, with spring member 70 being retained in position by inward projecting fingers 74 integrally formed in the latch bolt assembly housing 46. These fingers may be bent to positively clamp and retain the spring member 70, or alternatively, may merely project inward to entrap the spring member 70 thereon.

Figure 2:
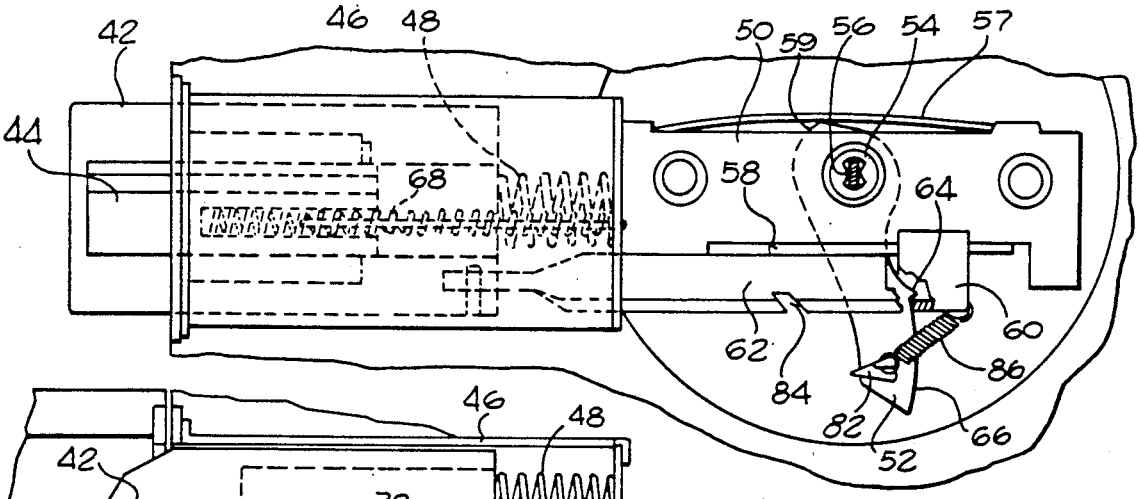
FIG. 2 is a partial cross-section taken along line 2—2 of FIG. 1.

The normal or undeflected state of the spring member 70 is as shown in FIG. 6, namely, normally deflected toward the latch bolt 42 so as to project into a slot 78 adjacent the inner end thereof. Thus, in this position, only a slight increase in the extension of bolt 42 will result in the inner end of portion 80 of the spring member 70 bottoming in the opening 78 of the bolt, thereby preventing any further extension of the bolt. Thus, in the first instance, the hook or dog like member 64 of cam 52 (see FIG. 2) will engage end 60 of the slide to prevent the latch bolt 42 from extending beyond the normal latch bolt extended position, with portion 80 of spring 70 bottoming in opening 78 of the latch if, without more, cam member 52 is rotated clockwise to release finger 64 thereon from the slide. The position of cam 52 shown in FIG. 2 represents the door unlocked condition. In this position the bolt is retained in the normal latch bolt extended position by finger 64 on cam 52.

When the latch bolt is withdrawn, as shown in FIG. 5, either by rotation of one of the knobs or by the camming of the latch bolt by the striker plate upon closing the door, both the latch bolt 42 and the sensing pin 44 will be withdrawn as illustrated in FIG. 5. In this position the sensing pin 44 is forced against portion 80 of spring 70, deflecting the end thereof away from the slot 78 in the latch bolt 42 as shown in FIG. 5. Thereafter, when the latch bolt pops into, or is allowed to extend into the striker plate under the force of latch bolt spring 48 (see FIG. 3), the sensing pin 44 will be prevented from following, thereby allowing the latch bolt to extend to the latch bolt extended position, at which position it will be retained by the engagement of finger 64 with end 60 of the slide coupled to the latch bolt 42 (see FIG. 2). Thus, while the sensing pin 44 retains spring 70 in the deflected position so as to not interfere with the further extension of the latch bolt, the latch bolt is still retained by the finger 64 on cam member 52 as shown in FIG. 2.

Figure 7:
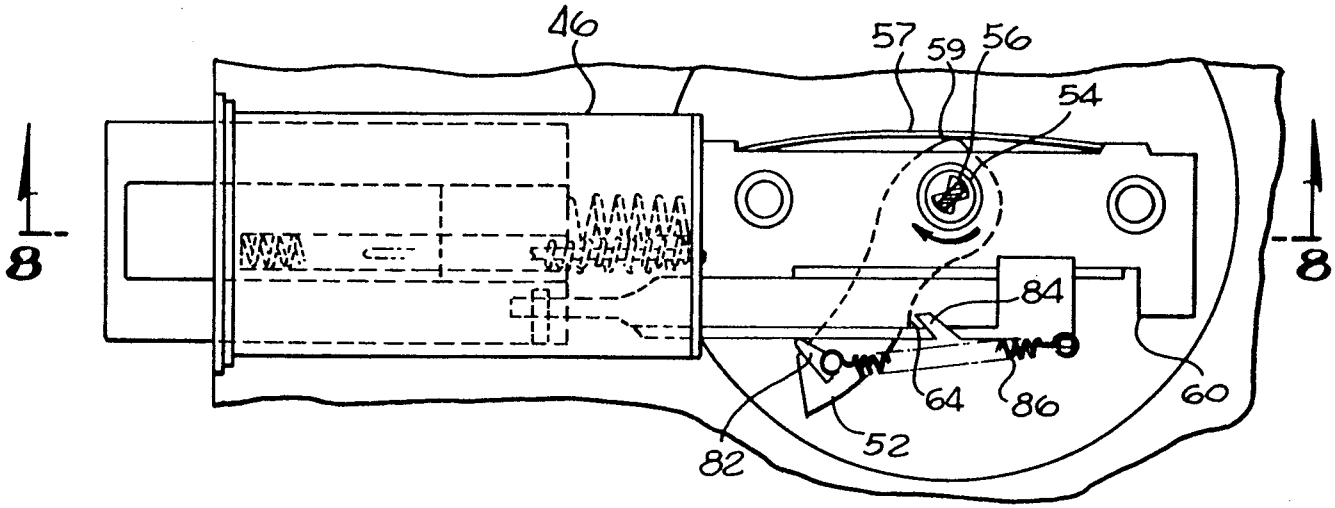
FIG. 7 is a partial cross-section similar to FIG. 2 though illustrating the cam member 52 in the locked position corresponding to the door open but lock locked condition.
Figure 9:
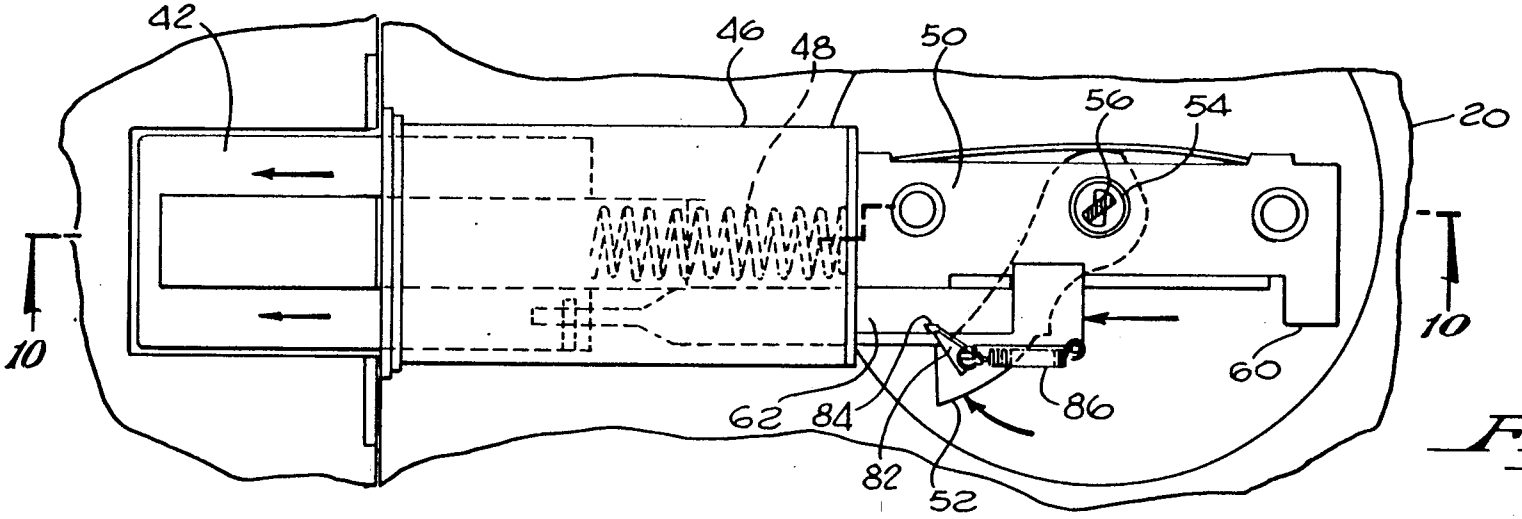
FIG. 9 is a view similar to FIG. 7 though showing the lock in the door closed position and the latch bolt extended to the deadbolt position.

If the cam member 52 is rotated to the locked position with the door open, as shown in FIG. 7 and 8, the latch bolt is still retained at the latch bolt extended position by spring member 70 engaging slot 78 in the latch bolt. Thus, contrary to the conventional Weiser bolt lock set, the lock may be "locked" with the door open without extending the latch bolt to the deadbolt extended position. This enables one leaving a premises without a key to still utilize the deadbolt feature of the lock, as upon closure of the door with the lock in the locked position, portion 80 of spring 70 will be deflected out of the slot 78 in the latch bolt 42 as illustrated in FIG. 5. Consequently, when the latch bolt snaps into the opening in the striker plate, it will not be retained at the latch bolt extended position by spring 70 because of the continued deflection thereof by the sensing pin 44 as illustrated in FIG. 3. It also will not be retained at the latch bolt extended position by finger 64 on the cam 52 as previously illustrated with respect to FIG. 2 because of the same being rotated to the different position illustrated in FIGS. 7 and 8. Accordingly, the latch bolt 42 will now be extended to a deadbolt extended position as illustrated in FIG. 9 and 10. This of course, is the same position that the Weiserbolt will extend to immediately upon "locking" of the lock, even with the door open. Thus, while in the Weiserbolt deadbolt feature of the lock cannot be used by someone leaving the premises who does not have a key, the present invention modifies such lock to provide just such a capability.

In the Weiserbolt, the latch bolt is maintained in the deadbolt extended position by the engagement of the finger 64 on a central forward position of the slide to prevent withdrawal of the latch bolt without unlocking the bolt by rotation of the cam member 52. In the present invention however, the required ability of the latch bolt to move to latch bolt withdrawn position during door closing even with cam 52 in the locked position of FIG. 7 requires that the slide be of a generally open construction, as illustrated by the side rails 62 of the slide and the elongate slot 61 therebetween as shown in FIG. 8, so as to not have corresponding structure to engage a finger on the cam member. Accordingly, for this purpose cam member 52 in the preferred embodiment is provided with a pair of ear-like side extensions 82 which will slide along the bottom of the slide as the bolt is first retracted by engagement with the striker plate and then extend under the force of coil spring 48 to the deadbolt extended position, at which time the extension 82 on cam member 52 will fall within cooperatively disclosed slots 84 in the side members 62 as shown in FIGS. 9 and 10. Thus, as with the Weiserbolt, the latch bolt when reaching the deadbolt extended position will be locked in that position and can only be withdrawn by unlocking the lock by rotation of the cam member 52 from the position shown in FIG. 9 and 10 at least to the position of FIG. 3, or for unlatching, to the position of FIG. 4.

In FIGS. 2, 4, 7 and 9, a small coil spring 86 is shown extending between the end 60 of the slide and cam member 52. This spring is optional, though in a prototype lock in accordance with the present invention, was found to improve the movement of the mechanism and assures the proper extension of the latch bolt to the deadbolt extended position when desired. It is optional however, as a more heavily preloaded and perhaps stronger latch bolt spring 48 would achieve the same result.

Now referring to FIGS. 11 through 14, an alternate embodiment of the present invention may be seen. In this embodiment, the function of sensing pin 44 of the previous embodiment is achieved by an alternate form of sensing pin 44*a*, with the function of spring 70 of the previous embodiment being performed by a rigid member, generally indicated by the numeral 90, which cooperates with an appropriately shaped groove 92 in the sensing pin 44*a*. In particular, the rigid finger-like member 90 has a projection 94 thereon which effectively provides a pivot point for the rigid member 90 by the engagement of the projection 94 within a stamped hole or opening in the latch bolt housing 46*a*. Except for the rigid member 90 replacing spring 70, sensing pin 44*a* replacing sensing pin 44, and the minor modification of the latch bolt assembly housing 46 to provide the housing 46*a*, the other parts of the lock, and for that matter, the entire lock operation are the same as in the previously described embodiment. In particular, FIG. 13 illustrates the state of the latch mechanism when the door is open. This Figure is applicable when the cam member 52 (see the previously described embodiment) is in the unlocked position as illustrated in FIG. 2, or in the door "locked" position as illustrated in FIG. 7. In this condition the latch bolt 42 as well as the sensing pin 44*a* are both in the latch bolt extended position. In this position, member 90 is cammed to the position shown by the cam surface 96 defining the bottom of the slot 92, resulting in end 98 of member 90 projecting into groove 78 in the latch 42 to prevent the latch from further extending independent of whether the lock is locked or unlocked. On the other hand, when both the latch bolt 42 and the sensing pin 44*a* are withdrawn, as illustrated in FIG. 12, either by operation of one of the door knobs, or by key or the inner lock control or during closing of the door against the striker plate, member 90 cams to the position shown, withdrawing end 98 of rigid member 90 from the groove 78 in the latch 42.

If now latch 42 and sensing pin 44*a* are allowed to extend together to the latch bolt latched position of FIG. 13, rigid member 90 will cam back to the position shown in FIG. 13 to again engage groove 78 of the latch bolt 42 to prevent the same from further extending even if the lock mechanism is "locked". If on the other hand a striker plate such as striker plate 100 of FIG. 11 retains the sensing pin 44*a* from significantly extending from the position shown in FIG. 12 as latch bolt 42 extends into the striker plate, member 90 will no longer restrain the latch bolt 42 from further extension beyond the latch bolt extended position. Thus, if cam member 52 is in the unlocked position corresponding to FIG. 2, the latch bolt will stop at the position shown in FIG. 11. If on the other hand cam member 52 is in the locked position corresponding to FIG. 7, latch bolt 42 will further extend to an equivalent deadbolt extended position as shown in FIG. 14 with cam member 52 locking the latch bolt in the deadbolt extended position by engagement of the extentions 82 with the groove 84 in the side member 62 (see FIG. 9). Thus the function of the embodiment of FIGS. 11 through 14 is identical to that of the earlier described lock, in one case being achieved by the timely deflection of a spring by the sensing pin, and in the other case by the withdrawal of a rigid member to achieve the same function.

The advantage of this mechanism over those of the prior art is that it is readily applicable to a current mass produced lock design with only minimal change thereto to provide the ability to use the deadbolt feature thereof without requiring the user to have and use a key to actuate the mechanism, and then of course only when the door is closed. The same is also applicable to deadbolt assemblies as opposed to latch bolt assemblies. This is illustrated in FIG. 15 wherein a deadbolt assembly in accordance with the present invention is shown mounted in door 101. The deadbolt assembly is comprised of an outer key lock mechanism 102, an inner knob control mechanism 104, and a deadbolt assembly 106. The inner and outer lock mechanisms 102 and 104 may be the conventional Weiser deadbolt lock assemblies, with the deadbolt 106 being similar to the latch bolt assembly hereinbefore described, altered primarily through the use of a different cam 108 as shown in FIG. 16, a view of the latch assembly in the unlocked condition similar to the view of FIG. 2 of the latch bolt in the corresponding position, the deadbolt of course, when unlocked, being fully withdrawn. Thus, cam 108 rotates to the position shown when the deadbolt 110 is fully withdrawn, retaining the deadbolt in that position by end 60 of the deadbolt assembly engaging the end 112 of the cam 108.

When the deadbolt is "locked" with the door open, as by rotation of the inner deadbolt control 114 (FIG. 15), the deadbolt moves to the equivalent of the latch extended position of the latch bolts hereinbefore described, with cam 108 essentially duplicating the position of ca 52 shown in FIG. 7. The deadbolt of course is retained in the equivalent of the latch bolt extended position in the same manner as the latch bolt of FIG. 7, namely, by the engagemnt of a spring similar to spring 70 of the embodiment of FIGS. 1 through 10, or alternatively a cam member similar to cam member 90 of the embodiment of FIGS. 11 through 14, with the bolt. Upon closure of the door of course, the spring is deflected or the cam member repositioned so as to not interfere with the full extension of the bolt as hereinbefore described, thereby allowing the deadbolt 110 to fully extend to the deadbolt extended position. Thus it may be seen that substantially the same bolt assembly, other than the cam therein, may be used in either the latch bolt or deadbolt configurations to provide the automatic deadbolt extension upon closure of the door, allowing one to use the deadbolt feature in locking a door without having a key to do so.

While various embodiments of the present invention have been disclosed and described herein, it will be understood by those skilled in the art that various changes in form and detail may be made therein without departing from the spirit and scope of the invention.

I claim:

1. A door latch assembly comprising:

a latch bolt housing for mounting in a door with a first outer end thereof substantially flush with the edge of the door, said latch bolt housing having a first portion adjacent said first outer end thereof;

a latch bolt slidable within said first portion of said latch bolt housing between a latch bolt withdrawn position, through a latch bolt extended position to a deadbolt extended position;

a sensing pin within and slidable with respect to said first portion of said latch bolt housing and said latch bolt between sensing pin extended and sensing pin retracted positions corresponding to said latch bolt extended and withdrawn positions, respectively, said sensing pin being limited in motion with respect to said latch bolt so as to be forced to said sensing pin retracted position when said latch bolt is moved to the latch bolt withdrawn position, said sensing pin having a cam surface;

a latch bolt spring means yieldably encouraging said latch bolt to the deadbolt extended position;

a sensing pin spring means yieldably encouraging said sensing pin to the sensing pin extended position;

a cam member rotatably supported in said latch bolt housing by cam member support means adjacent a second opposite end of said latch bolt housing, said cam member when in a first position preventing said latch bolt from extending beyond said latch bolt extended position, said cam member being rotatable in a first direction to withdraw said latch bolt and rotatable in a second direction toward a second position to allow said latch bolt to move to said deadbolt position and to retain the same at said last named position until said cam member is again rotated in said first direction; and, a latch bolt retaining member operatively connected to said latch bolt housing, said retaining member having a first portion adapted to engage said sensing pin cam surface such that said retaining member engages said latch bolt preventing said latch bolt from extending beyond the extended position when said sensing pin is in the extended position, said retaining member further having a second portion adapted to engage said sensing pin cam surface such that said retaining member is disengaged from said latch bolt when said sensing pin is in said retracted position allowing said latch bolt to extend into the deadbolt position.

2. The door latch assembly of claim 1 further comprised of inner and outer door latch operating assemblies, including a key operated lock mechanism on said outer door latch operating assembly and a manually operable lock on said inner door latch operating assembly.

3. The door latch assembly of claim 1 wherein said latch bolt includes a latch bolt extension having a slot therein, said cam member being operative within said slot to engage one end thereof when said cam member is rotated in said first direction to withdraw said latch bolt, and to rotate within a predetermined freedom within the slot when rotated in said second direction toward said second position to allow said latch bolt to move to said deadbolt position.

4. A door bolt assembly comprising;

a bolt housing for mounting in a door with a first outer end thereof substantially flush with the edge of the door, said bolt housing having a first portion adjacent said first outer end thereof;

a bolt slidable within said first portion of said bolt housing between a bolt withdrawn position, through a latch bolt extended position to a deadbolt extended position, said bolt being adapted to cam to the withdrawn position when engaging a striker plate from the bolt extended position;

a sensing pin within and slidable with respect to said first portion of said bolt housing and said bolt between sensing pin extended and sensing pin retracted positions corresponding to said latch bolt extended and bolt withdrawn positions, respectively, said sensing pin being limited in motion with respect to said bolt so as to be forced to said sensing pin retracted position when said bolt is moved to the bolt withdrawn position, said sensing pin having a cam surface;

a bolt spring means yieldably encouraging said bolt to the deadbolt extended position;

a sensing pin spring means yieldably encouraging said sensing pin to the sensing pin extended position;

a cam member rotatably supported in said bolt housing by cam member support means adjacent a second opposite end of said bolt housing, said cam member, when in a first position preventing said bolt from extending beyond one of said bolt extended and said bolt withdrawn positions, said cam member being rotatable in a first direction to withdraw said bolt to the bolt withdraw position and rotatable in a second direction toward a second position to allow said bolt to move to said deadbolt extended position and to retain the same at said last named position until said cam member is again rotated in said first direction; and, a bolt retaining member operatively connected to said bolt housing, said retaining member having a first portion adapted to engage said sensing pin cam surface such that said retaining member engages said bolt preventing said bolt from extending beyond the extended position when said sensing pin is in the extended position, said retaining member further having a second portion adapted to engage said sensing pin cam surface such that said retaining member is disengaged from said bolt when said sensing pin is in said retracted position allowing said bolt to extend into the deadbolt position.

5. The door bolt assembly of claim 4 further comprised of inner and outer door latch operating assemblies, including a key operated lock mechanism on said outer door latch operating assembly and a manually operable lock on said inner door latch operating assembly.

6. The door bolt assembly of claim 4 wherein said door bolt assembly is a deadbolt assembly and wherein said cam member, when in said first position, prevents said bolt from extending beyond said bolt withdrawn position.

7. The door bolt assembly of claim 6 wherein said bolt includes a bolt extension having a slot therein, said cam member being operative within said slot to engage one end thereof when said cam member is rotated in said first direction to withdraw said bolt, and to rotate within said predetermined freedom within the slot when rotated in said second direction toward said second position to allow said bolt to move to said deadbolt position.

8. The door latch assembly of claim 4 wherein said bolt includes a bolt extension having a slot therein, said cam member being operative within said slot to engage one end thereof when said cam member is rotated in said first direction to withdraw said bolt, and to rotate within a predetermined freedom within the slot when rotated in said second direction toward said second position to allow said bolt to move to said deadbolt position.

9. A door latch assembly comprising;

a latch bolt housing for mounting in a door with a first outer end thereof substantially flush with the edge of the door, said latch bolt housing having a first portion adjacent said first outer end thereof;

a latch bolt slidable within said first portion of said latch bolt housing between a latch bolt withdrawn position, through a latch bolt extended position to a deadbolt extended position;

a sensing pin within and slidable with respect to said first portion of said latch bolt housing and said latch bolt between a sensing pin extended and sensing pin retracted positions corresponding to said latch bolt extended and withdrawn positions, respectively, said sensing pin being limited in motion with respect to said latch bolt so as to be forced to said sensing pin retracted position when said latch bolt is moved to the latch bolt withdrawn position, said sensing pin having a cam surface;

a latch bolt spring means yieldably encouraging said latch bolt to the deadbolt extended position;

a sensing pin spring means yieldably encouraging said sensing pin to the sensing pin extended position;

a cam member rotatably supported in said latch bolt housing by cam member support means adjacent a second opposite end of said latch bolt housing, said cam member being rotatable in a first direction to withdraw said latch bolt to the latch bolt withdrawn position and rotatable in a second direction toward a second position to allow said latch bolt to move to said deadbolt position and to retain the same at said last named position until said cam member is again rotated in said first direction; and, a latch bolt retaining member operatively connected to said latch bolt housing, said retaining member having a first portion adapted to engage said sensing pin cam surface such that said retaining member engages said latch bolt preventing said latch bolt from extending beyond the extended position when said sensing pin is in the extended position, said retaining member further having a second portion adapted to engage said sensing pin cam surface such that said retaining member is disengaged from said latch bolt when said sensing pin is in said retracted position allowing said latch bolt to extend into the deadbolt position.

10. The door latch assembly of claim 9 further comprised of inner and outer door latch operating assemblies, including a key operated lock mechanism on said outer door latch operating assembly and a manually operable lock on said inner door latch operating assembly.

11. A door bolt assembly comprising;

a bolt housing for mounting in a door with a first outer end thereof substantially flush with the edge of the door, said bolt housing having a first portion adjacent said first outer end thereof;

a bolt slidable within said first portion of said bolt housing between a bolt withdrawn position, through a latch bolt extended position to a deadbolt extended position, said bolt being adapted to cam to the withdrawn position when engaging a striker plate from the latch bolt extended position;

a sensing pin within and slidable with respect to said first portion of said bolt housing and said bolt between sensing pin extended and sensing pin retracted positions corresponding to said latch bolt extended and bolt withdrawn positions, respectively, said sensing pin being limited in motion with respect to said bolt so as to be forced to said sensing pin retracted position when said bolt is moved to the bolt withdrawn position, said sensing pin having a cam surface;

a bolt spring means yieldably encouraging said bolt to the deadbolt extended position;

a sensing pin spring means yieldably encouraging said sensing pin to the sensing pin extended position;

a cam member rotatably supported in said bolt housing by cam member support means adjacent a second opposite end of said bolt housing, said cam member being rotatable in a first direction to withdraw said bolt to the bolt withdrawn position and rotatable in a second direction toward a second position to allow said bolt to move to said deadbolt extended position and to retain the same at said last named position until said cam member is again rotated in said first direction; and, a bolt retaining member operatively connected to said bolt housing, said retaining member having a first portion adapted to engage said sensing pin cam surface such that said retaining member engages said bolt preventing said bolt from extending beyond the extended position when said sensing pin is in the extended position, said retaining member further having a second portion adapted to engage said sensing pin cam surface such that said retaining member is disengaged from said bolt when said sensing pin is in said retracted position allowing said bolt to extend into the deadbolt position.

12. The door bolt assembly of claim 11 further comprised of inner and outer door latch operating assemblies, including a key operated lock mechanism on said outer door latch operating assembly and a manually operable lock on said inner door latch operating assembly.

13. The door latch assembly of claim 11 wherein said bolt includes a bolt extension having a slot therein, said cam member being operative within said slot to engage one end thereof when said cam member is rotated in said first direction to withdraw said bolt, and to rotate within a predetermined freedom within the slot when rotated in said second direction toward said second position to allow said bolt to move to said deadbolt position.

* * * * *